US009750384B2

(12) United States Patent
Eisenhut et al.

(10) Patent No.: US 9,750,384 B2
(45) Date of Patent: Sep. 5, 2017

(54) FLAT WIPING CLOTH HAVING AN ANTIMICROBIAL OR ANTIBACTERIAL FINISH

(75) Inventors: Andreas Eisenhut, Leimen (DE); Petra Bargon, Darmstadt (DE); Hilmar Eichelbroenner, Oftersheim (DE); Thorsten Gleich, Grasellenbach (DE); Ulla Reiman, Salo (FI); Frédéric Petit, Wezembeek-Oppem (BE)

(73) Assignee: Carl Freudenberg KG, Weinheim (DE)

( * ) Notice: Subject to any disclaimer, the term of this patent is extended or adjusted under 35 U.S.C. 154(b) by 830 days.

(21) Appl. No.: 14/131,842

(22) PCT Filed: May 16, 2012

(86) PCT No.: PCT/EP2012/002110

§ 371 (c)(1),
(2), (4) Date: Apr. 24, 2014

(87) PCT Pub. No.: WO2013/007327

PCT Pub. Date: Jan. 17, 2013

(65) Prior Publication Data

US 2014/0373296 A1 Dec. 25, 2014

(30) Foreign Application Priority Data

Jul. 12, 2011 (DE) ..... 10 2011 107 648

(51) Int. Cl.

| | |
|---|---|
| ***A47L 13/16*** | (2006.01) |
| ***A47L 13/20*** | (2006.01) |
| ***A47L 13/255*** | (2006.01) |
| ***A47L 13/44*** | (2006.01) |
| ***D01F 1/10*** | (2006.01) |

(52) U.S. Cl.

CPC ..... *A47L 13/16* (2013.01); *A47L 13/20* (2013.01); *A47L 13/255* (2013.01); *A47L 13/44* (2013.01); *D01F 1/103* (2013.01)

(58) Field of Classification Search

CPC ..... A47L 13/20; A47L 13/255; A47L 13/44
See application file for complete search history.

(56) References Cited

U.S. PATENT DOCUMENTS

| | | | |
|---|---|---|---|
| 4,010,511 | A | 3/1977 | Komatsu |
| 2003/0157147 | A1 | 8/2003 | Hoge et al. |
| 2004/0100591 | A1 | 5/2004 | Griesse |

(Continued)

FOREIGN PATENT DOCUMENTS

| | | | |
|---|---|---|---|
| CA | 2 527 510 | A1 | 12/2004 |
| CN | 1346264 | A | 4/2002 |

(Continued)

*Primary Examiner* — Randall Chin

(74) *Attorney, Agent, or Firm* — Leydig, Voit & Mayer, Ltd.

(57) ABSTRACT

A flat wiping cloth for arrangement on a wiping cloth holder includes an elongated base body and an active ingredient that inhibits or suppresses the growth of bacteria or viruses. The active ingredient is allocated to the base body. The base body has at least one of fibers, yarns or fringe, which have free ends that can be oriented to face a surface to be cleaned during use. The active ingredient is distributed within a material of which the fibers, yarns or fringe is made, or is distributed in a component of the base body.

14 Claims, 10 Drawing Sheets

(56) References Cited

U.S. PATENT DOCUMENTS

| | | | | |
|---|---|---|---|---|
| 2004/0200591 | A1 | 10/2004 | Dussaud | |
| 2005/0044650 | A1* | 3/2005 | Goldberg | A47L 13/20 15/229.1 |
| 2005/0132519 | A1* | 6/2005 | Chen | A47L 13/44 15/121 |
| 2005/0136100 | A1 | 6/2005 | Foss | |
| 2006/0228161 | A1* | 10/2006 | Hoadley | A46B 5/0075 401/138 |
| 2008/0016640 | A1 | 1/2008 | Reddy et al. | |

FOREIGN PATENT DOCUMENTS

| | | | |
|---|---|---|---|
| CN | 101896209 | A | 11/2010 |
| CN | 101903578 | A | 12/2010 |
| DE | 100 10 572 | A1 | 9/2001 |
| DE | 102 35 305 | A1 | 2/2004 |
| DE | 20 2004 020 313 | U1 | 4/2005 |
| EP | 0 909 549 | A1 | 4/1999 |
| EP | 1 496 144 | A1 | 1/2005 |
| GB | 2400308 | A | 10/2004 |
| JP | H04-77939 | U | 7/1992 |
| JP | 3031008 | U | 8/1996 |
| JP | 11-221183 | A | 8/1999 |
| JP | 2001-104228 | A | 4/2001 |
| JP | 2002-165741 | A | 6/2002 |
| JP | 2005-139292 | A | 6/2005 |
| JP | 3115048 | U | 9/2005 |
| JP | 2010-150708 | A | 7/2010 |
| JP | 2010-220936 | A | 10/2010 |
| WO | WO 95/22277 | A1 | 8/1995 |
| WO | WO 00/60993 | A1 | 10/2000 |
| WO | WO 00/61107 | A1 | 10/2000 |
| WO | WO 2006/119391 | A1 | 11/2006 |
| WO | WO 2008/054278 | A1 | 5/2008 |
| WO | WO 2009/082136 | A1 | 7/2009 |

* cited by examiner

FLAT WIPING CLOTH HAVING AN ANTIMICROBIAL OR ANTIBACTERIAL FINISH

CROSS-REFERENCE TO RELATED APPLICATIONS

This patent application is the national phase of PCT/EP2012/002110, filed May 16, 2012, which claims the benefit of German Patent Application No. 10 2011 107 648.8, filed Jul. 12, 2011.

FIELD OF THE INVENTION

The invention relates to flat wiping cloths.

BACKGROUND OF THE INVENTION

WO 02/071 914 A1 discloses a textile layer that may be used as a covering for a dust mop. This textile layer has yarns into which silver is incorporated. The layer particularly has loops which protrude out of the layer.

DE 20 2004 020 313 U1 discloses a flat wiping cloth that is provided with an active ingredient for inhibiting or suppressing the growth of bacteria and/or viruses. Silver ions having antibacterial and antimicrobial properties are proposed in very specific terms. The disclosed flat wiping cloth has fibers coated with silver.

One disadvantage of the flat wiping cloths disclosed in these references is that the antimicrobial active agent is released relatively easily into the environment. After only a few washing operations, the silver coating has been removed almost completely from the fibers. As a result, the coating can no longer provide any antimicrobial and/or antibacterial effects.

SUMMARY OF THE INVENTION

A general object of the present invention is to provide a flat wiping cloth having an antimicrobial active ingredient that remains in the flat wiping cloth for as long as possible and configured so that the flat wiping cloth picks up soiling from moist surfaces particularly rapidly.

A flat wiping cloth for arrangement on a wiping cloth holder is provided that includes an elongated base body and an active ingredient which inhibits or suppresses the growth of bacteria and/or viruses that is allocated to the base body. Fibers, yarn or fringe are also allocated to the base body and the active ingredient is distributed in the material made up of fibers, yarns or fringe and/or distributed in a component of the base body. The fibers, yarns or fringe have a free end, which may be turned to face the surface to be cleaned.

According to the invention, it was first recognized that the active ingredient must be distributed within the material comprised of the fibers, yarns or fringe in order for it to remain on the flat wiping cloth as long as possible. Additionally, or alternatively, the active ingredient can be absorbed within the component, namely by being incorporated into it.

Washing operations then release the active ingredient incorporated in this way out of the matrix of fibers, yarns or fringe and/or the component only very slowly. Advantageously, a flat wiping cloth according to the invention can still exhibit an antimicrobial effect even after 200-1300 washing cycles at 60° C., in particular in disinfectant washings.

In addition, it has been recognized that fibers, yarns or fringe having a free end act as a type of wick, along which dirt dissolved in water can be easily transported and/or with which the dirt dissolved with water may bond. If the free ends are facing a moist surface to be cleaned, the dirt particles are absorbed surprisingly easily by the fibers, yarns or fringe.

The dirt absorbed and/or the dirt particles absorbed come in contact with the antimicrobial active ingredient so that the formation of unpleasant odors, mold or fungi is effectively suppressed or reduced even before the disinfectant washing which is usually performed daily.

The free ends, in contrast with closed ends and/or loops, not only produces a wick effect which accelerates the transport of soiling and water in the flat wiping cloth, but also prevents the catching of fibers, yarns or fringe on rough structures. Such rough structures may occur when cleaning wooden floors having splinters or nails and/or when cleaning safety tiles.

The flat wiping cloth according to the invention therefore allows problem-free cleaning of floors. The flat wiping cloth according to the invention picks up soiling from a moist surface with no problem and is characterized by a permanent wash-fastness.

The active ingredient can be homogeneously distributed within the material. To do so, the active ingredient could be introduced into a melt of polyester, polyamide, polypropylene or the like for fiber production or a similar material conventionally used for fiber production. The fibers, in particular microfibers, can be produced by extrusion after the active ingredient is homogeneously distributed in the melt. The active ingredient is then uniformly and homogeneously distributed within the fiber body. This ensures a gradual release of the active ingredient to the environment.

Against this background, the active ingredient could be present in a nanoscale form. A nanoscale active ingredient has particles whose maximum diameter is less than or equal to 1 μm. A nanoscale active ingredient makes available a particularly large surface area and may therefore interact particularly well with bacteria, viruses or microorganisms.

The active ingredient might comprise elemental silver or some other subgroup element. The active ingredient might be present as elemental silver. Elemental silver can be processed in a melt particularly easily. The active ingredient might comprise at least one subgroup element. Subgroup elements are characterized by an antimicrobial effect. In view of this, it is conceivable that multiple subgroup elements might be present jointly in the active ingredient to selectively counteract different bacterial species. In a series of experiments, it has been found that, with respect to the antimicrobial efficacy, there is a ranking of the substances used. In addition to silver, known options include mercury, copper, cadmium, chromium, lead, cobalt, gold, zinc and iron and manganese. Based on this, main group elements which have an antimicrobial effect could also be used.

The antimicrobial active ingredient might comprise a gold-silver mixture or might contain only a gold-silver mixture. Mixtures of this type have a particularly high antimicrobial efficacy. It has surprisingly been found that the presence of gold further increases the antimicrobial effect of silver. In view of this, silver can be doped with gold. Islands or clusters comprising either only gold or only silver or also mixtures of these substances also can be formed. Islands or clusters of various compositions may also be present concurrently.

Aluminum may also be added to the active ingredient. Aluminum produces a long-term brightening effect and/or an improved visual appearance, for example, because silver turns brown due to oxidation processes. Aluminum also modifies the rate of release of the antimicrobial active ingredient.

The active ingredient might be present in the form of a silver salt. Silver salts can be easily dissolved and processed.

The active ingredient might be accommodated in a ceramic carrier. The active ingredient can preferably be accommodated in a ceramic ball. The ceramic carrier ensures that the active ingredient can be easily dispersed within a melt. Mixing problems can be prevented by using a ceramic carrier.

The active ingredient might be present in a fiber, a yarn or a fringe in an amount by weight of 0.0001% to 2%, preferably from 0.001% to 0.05%. The first range ensures that an adequate antimicrobial effect is achieved, while enabling the flat wiping cloth to be washed approximately 200 to 1300 times at 60° C. without losing its antimicrobial effect. The second range from 0.001% to 0.05% ensures that, although there is an antimicrobial effect, only a relatively small amount of antimicrobial active ingredient is released to the environment.

The active ingredient might be present in a fiber, a yarn or a fringe in an amount by weight of greater than 0.001%. A flat wiping cloth of such configuration may be used as a disposable product. Such a flat wiping cloth may be used only a few times, max. 100 times, but has no stable antimicrobial effect after 100-1500 washing cycles.

The flat wiping coating might have at least one base layer to which the fibers, yarns or fringe are attached and an active ingredient which inhibits or suppresses the growth of bacteria and/or viruses distributed in and/or on the base layer. Such an embodiment of the wiping coating ensures that the development of mold or fungus is prevented even in the range of the base layer. The active ingredient used in the base layer may be present in the aforementioned concentrations and properties. After the end of a cleaning operation, the fibers, yarns or fringe are often present on the base layer. In the case of a base layer finished with an antimicrobial active ingredient, the fibers, yarns or fringe may also be protected from the development of mold by the base layer in addition to their own intrinsic antimicrobial finish.

The active ingredient which is allocated to the base layer can manifest its antimicrobial effect in a wet or moist environment, even over a certain distance. Tests have shown that additional parts of the flat wiping cloth, which were not provided with an antimicrobial finish as part of the test setup, are also protected from microbial growth in this way. In view of this, it is also possible that the wiping cloth holder may also be at least partially protected from microbial growth by contact with the flat wiping cloth having the antimicrobial finish. The flat wiping cloth creates a type of an extended antimicrobial effect in a moist environment for small distances, namely in the millimeter range, by releasing the silver ions into the moist environment.

The active ingredient might be allocated to the base body in some zones, such that the zones in which the active ingredient is present form a pattern. With this specific embodiment, regions of the base body which are under greater stress may be finished with the active ingredient to a greater extent.

The fibers, yarns or fringe may also comprise microfibers. Microfibers have diameters in the range of 1 to 100 μm. Microfibers may be created by extrusion. In addition, microfibers may be created by splitting multicomponent fibers.

At least one pocket into which a receptacle of a wiping cloth holder can be inserted might be provided on the base body. With this specific embodiment, a so-called "butterfly" mop or "pocket" mop may be connected to the flat wiping cloth. Such a wiping cloth holder has two supporting wings, which can be pivoted in relation to one another that are insertable into two pockets of the flat wiping cloth. The pockets can be arranged on the longitudinal ends of the elongated base body of the flat wiping cloth.

Straps which can be inserted in a form-fitting or force-locking manner into receptacle devices of a wiping cloth holder may be provided on the base body. The straps can be arranged for this purpose in the region of the longitudinal ends of the elongated base body. The straps may be placed around a supporting wing of a wiping cloth holder in such a way that the flat wiping cloth is under tension. The straps may be inserted into clamp-like gaps or slots on the supporting wings of a wiping cloth holder. Thus, a form-fitting connection between the straps and a supporting wing of a wiping cloth holder can be achieved.

Flat regions which may be applied in a form-fitting manner to receiving regions of a wiping cloth holder could be allocated to the base body. With such an arrangement, receptacle regions can be formed on the underside of a supporting wing of a wiping cloth holder. The receptacle regions might cooperate with the flat regions on the base body in such a way as to form a hook-and-loop closure. In addition, so-called Velcro-type connecting elements also could be provided on the flat regions as well as on the receiving regions.

A wiping cloth holder might have a flat wiping cloth according to the invention. Such a wiping cloth holder may have a pronounced antimicrobial effect. The active ingredient incorporated into the fringe of the flat wiping cloth manifests its antimicrobial effect in a moist or wet environment, even over a certain distance.

Tests have shown that additional parts of the flat wiping cloth, for example, the base layer, the straps or the flat regions, which were not finished with an antimicrobial finish as part of the test setup, are also protected from microbial growth in this way.

The wiping cloth holder can also be protected at least partially from microbial growth by contact with the flat wiping cloth having the antimicrobial finish. The flat wiping cloth creates a type of extended antimicrobial effect in a moist environment for small distances, namely in the millimeter range, by releasing the silver ions into the moist environment.

The flat wiping cloth might be embodied as a flat wiping velour cloth. Velour is a material that is manufactured by allocating a yarn of multiple fibers to a base layer.

The flat wiping cloth might have a fringe. Such a flat wiping cloth may be produced by forming tufts or trim. Such flat wiping cloths may be produced relatively easily. In forming a trim, fringe or strands of multiple yarns, preferably six entangled yarns, are sewn onto a base layer.

There are various options for designing and refining the teaching of the present invention in an advantageous manner. To do so, reference is made to the following discussion of preferred specific embodiments of the flat wiping cloth according to the invention and to the drawings.

DETAILED DESCRIPTION OF THE INVENTION

Figure 1:
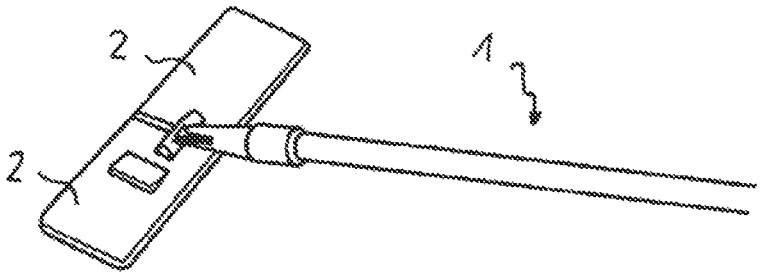
FIG. 1 is a perspective view of a wiping cloth holder having pivotable supporting wings.
Figure 2:
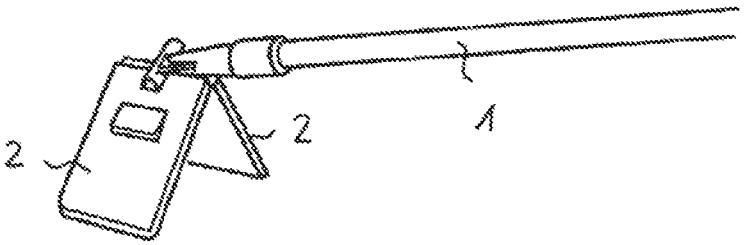
FIG. 2 is a perspective view of a wiping cloth holder according to FIG. 1, in which the supporting wings are inclined in relation to one another.

FIG. 1 shows a wiping cloth holder 1 having two supporting wings 2 that can be pivoted in relation to one another. FIG. 2 shows that the supporting wings 2 are pivoted above the short transverse axis in relation to one another and form an acute angle.

Figure 3:
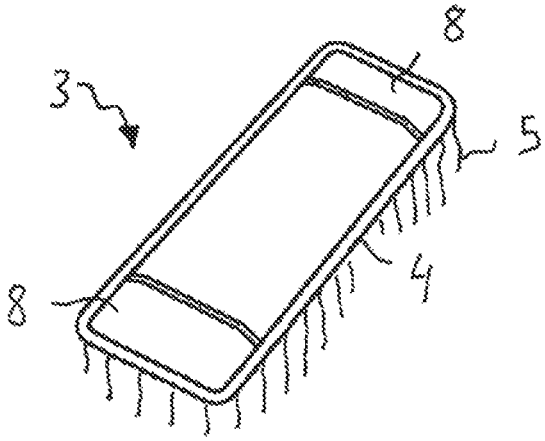
FIG. 3 is a perspective view of a flat wiping cloth that is designed with pockets to receive the supporting wings of the wiping cloth holder of FIG. 1.
Figure 19:
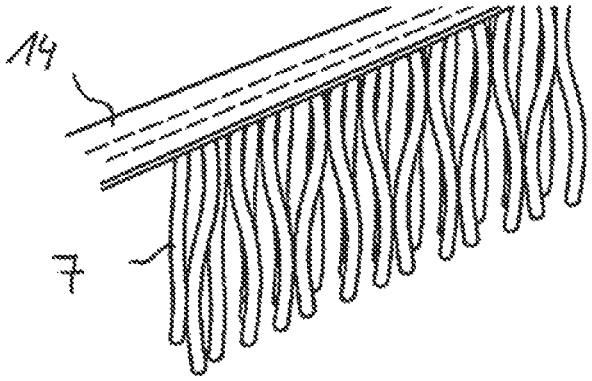
FIG. 19 is a partial, perspective view of a textile strip to which fringe has been sewn.
Figure 20:
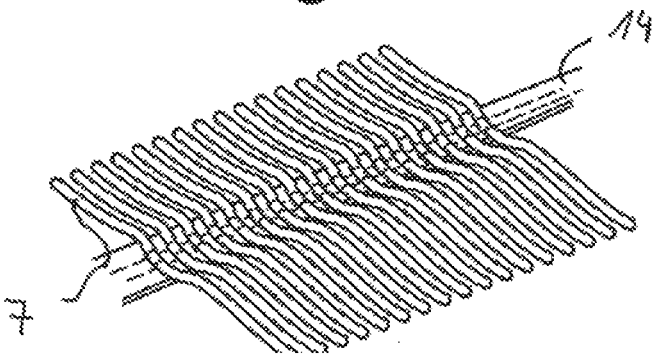
FIG. 20 is another perspective view of the textile strip of FIG. 19 showing an underside of the strip.
Figure 21:
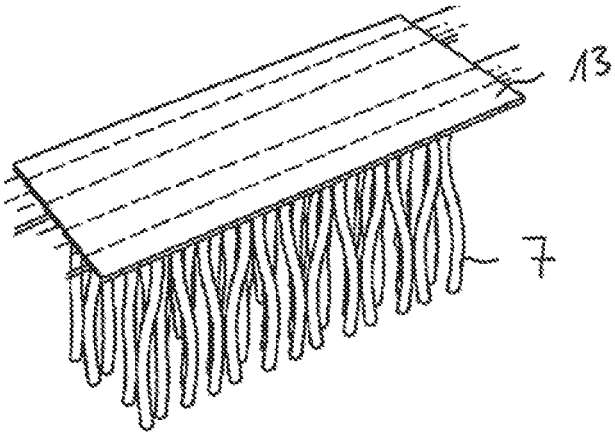
FIG. 21 is a perspective view of a base layer according to FIG. 18 to which textile strips according to FIG. 19 and FIG. 20 are sewn.
Figure 25:
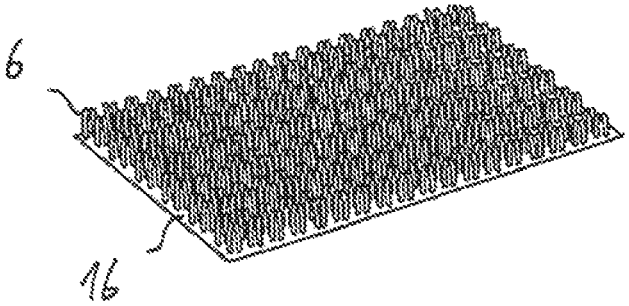
FIG. 25 is a perspective view of a textile layer from which yarns having one free end protrude.

FIG. 3 shows a flat wiping cloth 3 for arrangement on a wiping cloth holder 1. The wiping cloth 3 includes an elongated base body 4. An active ingredient, which inhibits or suppresses the growth of bacteria and/or viruses, is allocated to the base body 4. Fibers 5 are allocated to the base body 4 and the active ingredient is distributed within the material of which the fibers 5 or, in alternate embodiments, yarns 6 as shown in FIG. 25 or fringe 7 as shown in FIGS. 19-21 are produced. The fibers 5, yarns 6 or fringe 7 each have a free end that can be turned to face the surface to be cleaned.

Two pockets 8 into which a receptacle and/or a supporting wing 2 of the wiping cloth holder 1 can be inserted are arranged on the base body 4. Specifically, a pocket 8 is formed on each of the longitudinal ends of the base body 4.

Figure 4:
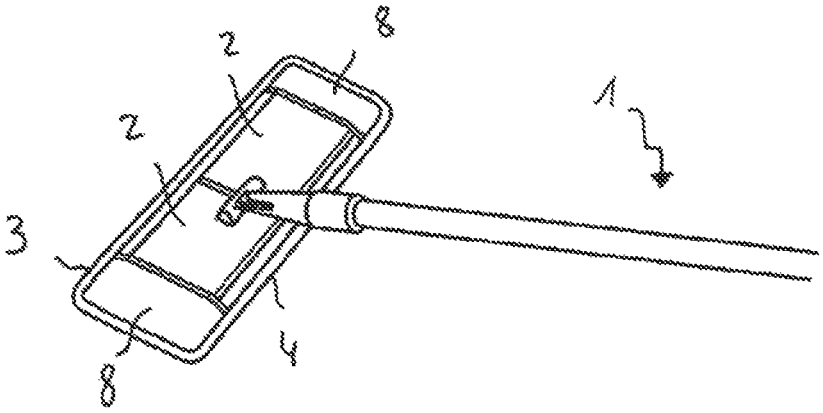
FIG. 4 is a perspective view of a wiping cloth holder with an attached flat wiping cloth according to FIG. 3.

FIG. 4 shows that the supporting wings 2 protrude into the pockets 8. The flat wiping cloth 3 is secured on the wiping cloth holder 1 in this way.

Figure 5:
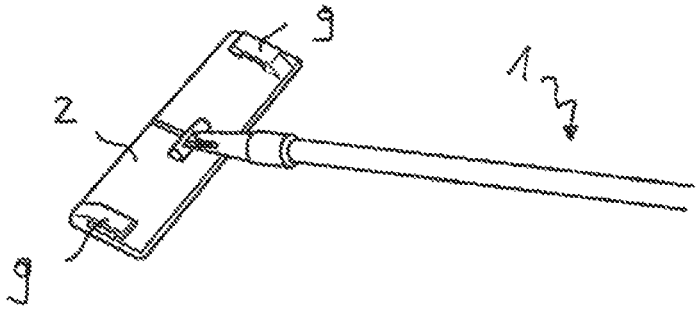
FIG. 5 is a perspective view of a wiping cloth holder in which clamp-like elements, namely gaps, are provided on the top side or end face to receive straps.

FIG. 5 provides a perspective view of a wiping cloth holder 1 having supporting wings to which clamp-like shaped elements 9 are allocated. The clamp-like elements 9 are arranged on the top side of the supporting wings 2, which top side of the supporting wings 2 usually faces away from the surface to be cleaned.

Figure 6:
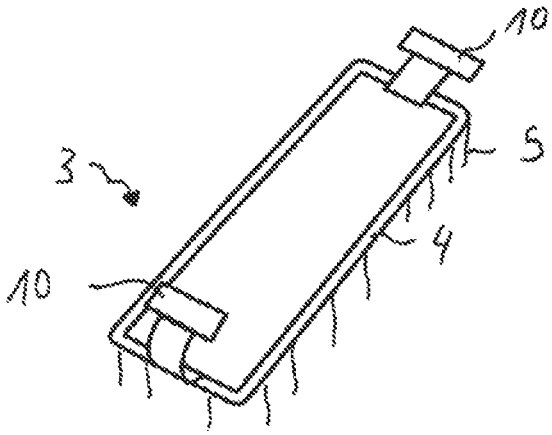
FIG. 6 is a perspective view of a flat wiping cloth having a strap provided on each of its longitudinal ends.

FIG. 6 provides a perspective view of a flat wiping cloth 3 having straps 10 that can be inserted into receptacle devices, namely the clamp-like elements 9 of the wiping cloth holder 1 in a force-locking or form-fitting manner. The straps 10 are arranged on the longitudinal ends of the base body 4.

Figure 7:
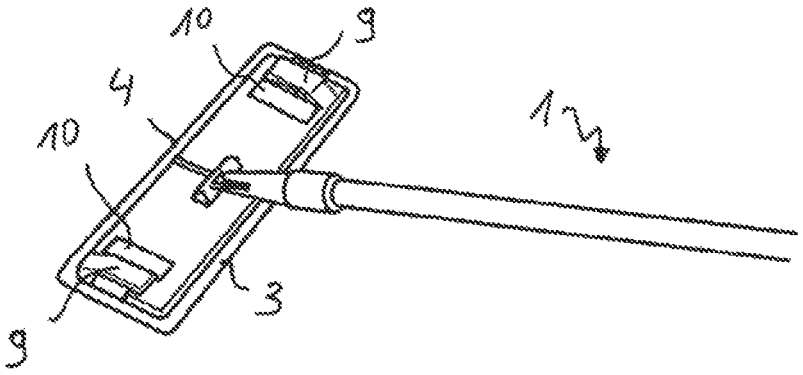
FIG. 7 is a perspective view of a wiping cloth holder with an attached a flat wiping cloth according to FIG. 6.

This assembly is shown in FIG. 7. The flat wiping cloth 3 of FIG. 6 is secured on the wiping cloth holder 1 in such a way that the straps 10 are gripped by the clamp-like elements 9.

Figure 8:
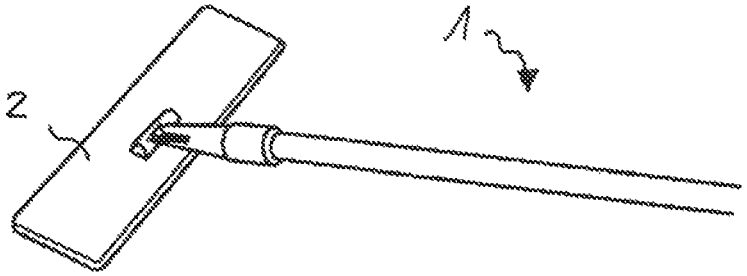
FIG. 8 is a perspective view of another embodiment of a wiping cloth holder.

FIG. 8 is another perspective view of a wiping cloth holder 1 having a supporting wing 2.

Figure 9:
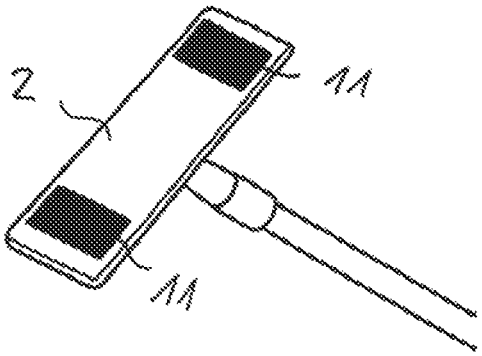
FIG. 9 is a perspective view of the wiping cloth holder of FIG. 8 showing that rectangular receiving areas are arranged on the underside of a supporting wing.

FIG. 9 shows that receptacle regions 11 are arranged on the underside of the supporting wing 2. Flat regions 12, which can engage the receptacle regions 11, can be applied to the base body 4 of the flat wiping cloth 3 as shown in FIG. 10.

Figure 10:
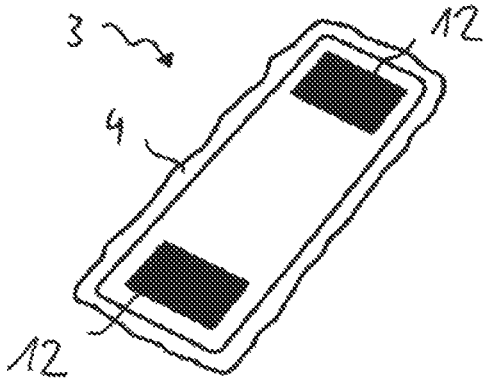
FIG. 10 is a perspective view of a flat wiping cloth having a base body with associated flat regions, which may be applied in a form-fitting manner to the receptacle regions of the wiping cloth holder of FIG. 9.
Figure 11:
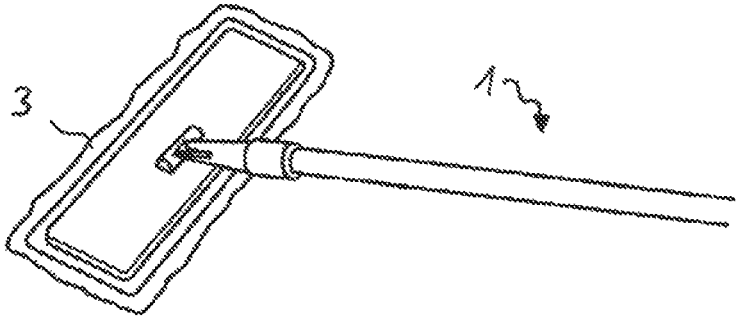
FIG. 11 is a perspective view of the wiping cloth holder of FIGS. 8 and 9 to which the flat wiping cloth of FIG. 10 is applied.

FIG. 11 shows the flat wiping cloth 3 of FIG. 10 secured on the wiping cloth holder 1 of FIG. 9. The receptacle regions 11 as well as the flat regions 12 can be designed as complementary hook-and-loop closures or Velcro-type closures.

Figure 12:
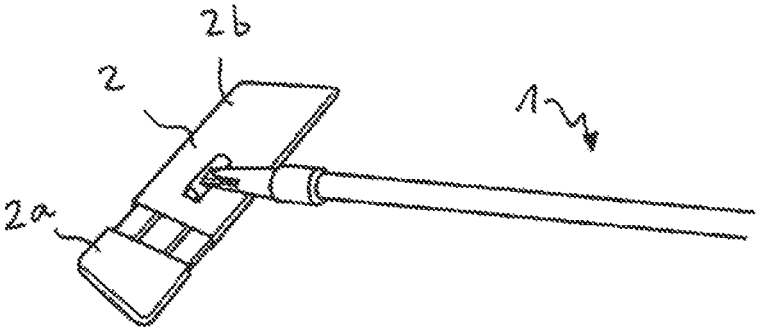
FIG. 12 is a perspective view of a wiping cloth holder having a supporting wing whose length is variable in an elastic manner.

FIG. 12 illustrates a wiping cloth holder 1 having a supporting wing 2 whose length can be varied elastically. This is accomplished by having a first part 2*a* of the supporting wing elastically displaceable within a second part 2*b* of the supporting wing 2.

Figure 13:
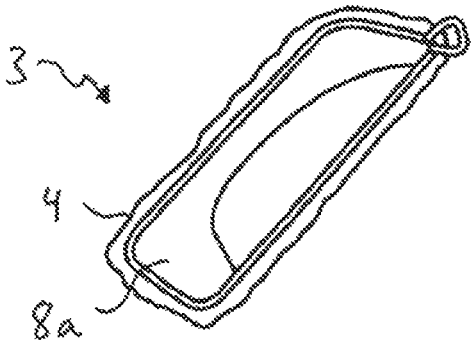
FIG. 13 is a perspective view of a flat wiping cloth having a pocket extending over the entire base body.

FIG. 13 shows a flat wiping cloth 3 on whose elongated base body 4 a pocket 8*a* formed that extends over almost the entire length of the base body 4. The pocket 8*a* is designed as a sheet-type pocket. This pocket 8*a* functions as a type of sheath.

Figure 14:
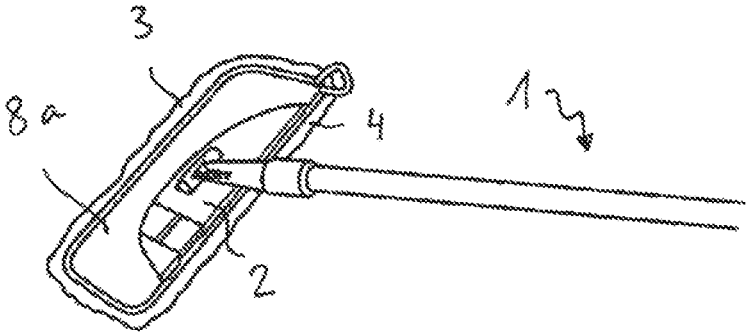
FIG. 14 is a partially cut away, perspective view of the wiping cloth holder of FIG. 12 on which the flat wiping cloth of FIG. 13 is arranged.

As shown in FIG. 14, the supporting wing 2 can be accommodated in a force-locking manner in the sheet-type pocket 8*a*. Due to the spring-force inherent in the supporting wing 2, the wing is held securely within the sheet-type pocket 8*a*.

Figure 15:
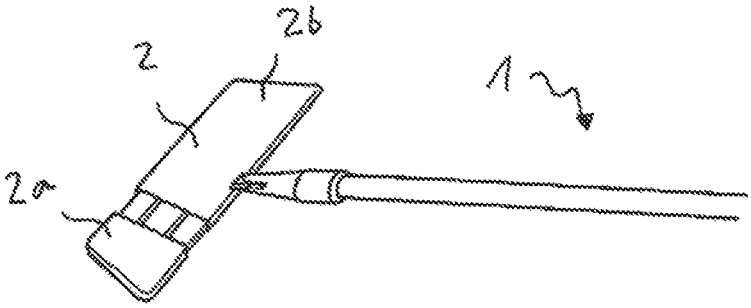
FIG. 15 is a perspective view of a wiping cloth holder having a supporting wing with an elastically variable length.

FIG. 15 shows a wiping cloth holder 1 with a supporting wing 2 whose length is variable elastically. The wiping cloth holder 1 of FIG. 15 has a structure similar to that of the wiping cloth holder 1 of FIG. 12. In contrast with the wiping cloth holder 1 of FIG. 12, the wiping cloth holder of FIG. 15 is connected to the stem or handle in such a way that both the top side and the bottom side of the wiping cloth holder 1 can be turned to face the surface to be cleaned.

Figure 16:
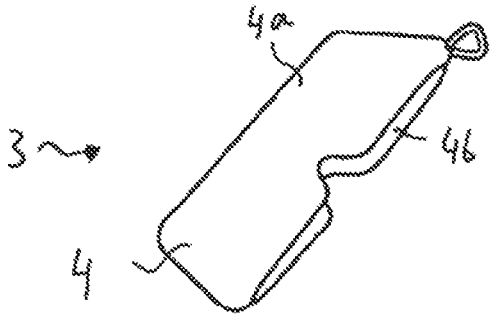
FIG. 16 is a perspective view of a flat wiping cloth having a base body with two layers forming a pocket.
Figure 17:
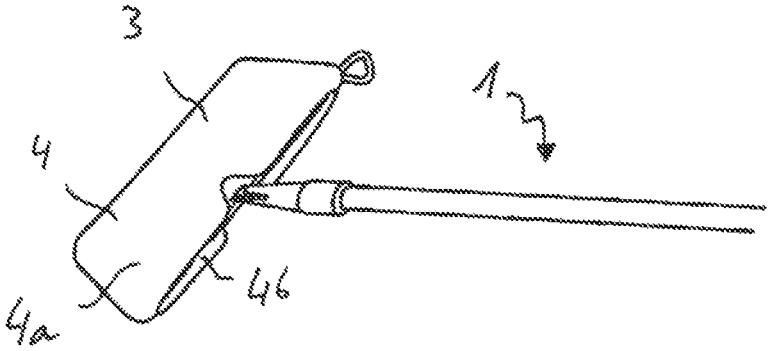
FIG. 17 is a perspective view of the wiping cloth holder of FIG. 15 to which a flat wiping cloth according to FIG. 16 is applied.

FIG. 16 shows a flat wiping cloth 3 whose base body 4 is produced from two layers 4*a*, 4*b*. The layers 4*a*, 4*b* form a pocket into which the supporting wing 2 of the wiping cloth holder 1 of FIG. 15 can be inserted in a force-locking manner. This is illustrated in FIG. 17.

Figure 18:
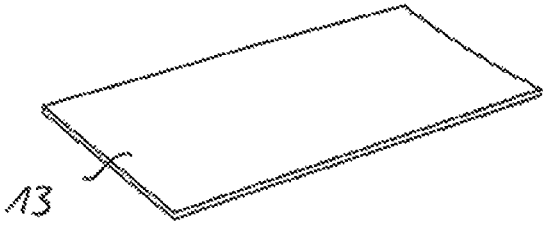
FIG. 18 is a perspective view of a base layer to which fibers, yarns or fringe may be applied.

A base layer 13 is shown in FIG. 18. FIG. 19 shows a textile strip 14, which is sewn to the fringe 7. The fringe 7 is produced from a plurality of yarns that are sewn to the textile strip 14 to form the trim as shown in FIG. 20. This trim is illustrated in FIG. 20. The fringe may also be sewn directly to itself without a textile strip.

FIG. 21 shows that the textile strip 14 of the trim of FIGS. 19 and 20 can be sewn to the base layer 13 of FIG. 18.

Figure 22:
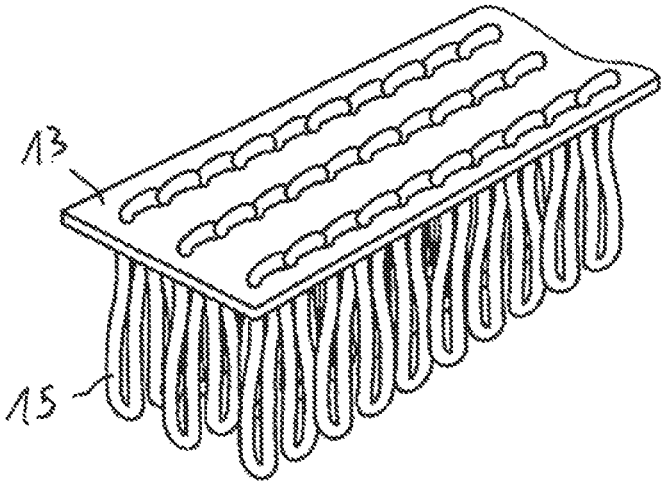
FIG. 22 is a perspective view of a base layer with attached loops.

FIG. 22 shows a base layer 13 in which loops 15 that do not have free wick-type ends are accommodated. FIG. 22 therefore does not constitute a flat wiping cloth 3 according to the invention.

Figure 23:
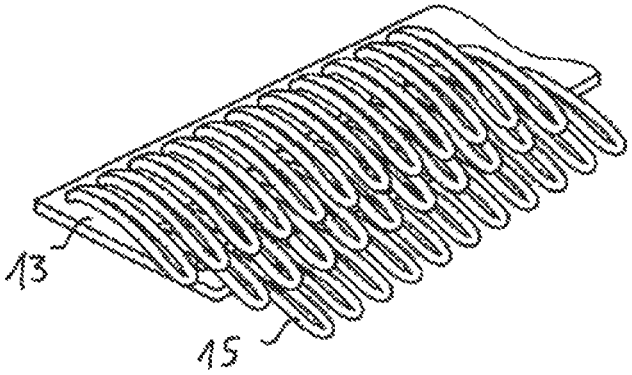
FIG. 23 is a perspective view of the base layer of FIG. 22 showing that the loops are arranged above one another.

FIG. 23 shows the arrangement according to FIG. 22 with the loops 15 arranged one above the other. FIG. 22 does not comprise a flat wiping cloth 3 according to the present invention.

Figure 24:
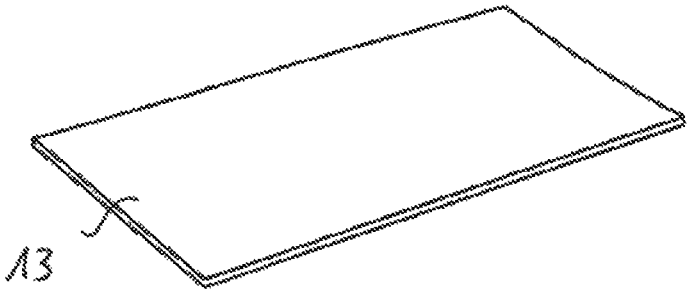
FIG. 24 is a perspective view of another embodiment of a base layer.
Figure 26:
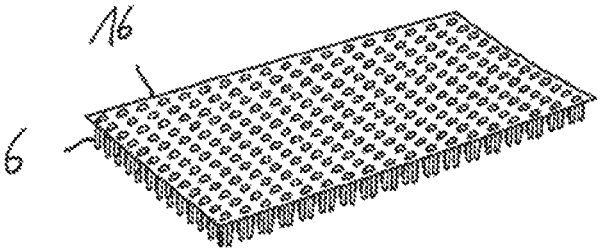
FIG. 26 is a perspective view of the textile layer of FIG. 25 showing that the yarns pass through openings in the textile layer or are woven with them, so that the textile layer is wrapped.

FIG. 24 shows another base layer 13 that can be sewn to a structure according to FIG. 25 or 26. However, the structure according to FIGS. 25 and 26 may also be used in isolation to produce the flat wiping cloth 3. The structure according to FIGS. 25 and 26 includes a textile layer 16 that is wrapped by or woven with yarns 6, so that the yarns 6 protrude at their free ends away from the textile layer 16.

Figure 27:
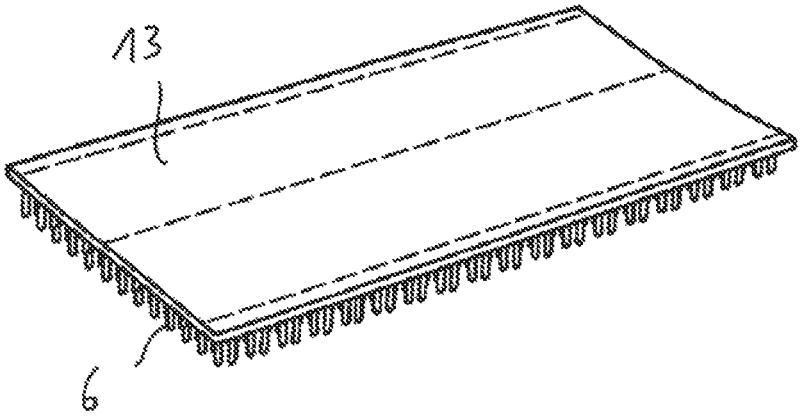
FIG. 27 is a perspective view of a flat wiping cloth in which the base layer of FIG. 24 is sewn to the textile layer of FIGS. 25 and 26.

FIG. 27 shows that the arrangement of FIGS. 25 and 26 can be sewn to the base layer 13.

In all the flat wiping cloths 3 shown in FIGS. 1 to 27, the active ingredient is homogeneously distributed inside the material of which the fibers 5, yarns 6 or fringe 7 is produced.

The active ingredient is present in a nanoscale form. The active ingredient may be present as elemental silver, as a silver salt or accommodated in a ceramic carrier.

The active ingredient is preferably present in a fiber 5, a yarn 6 or a fringe 7 in an amount by weight of 0.0001% to 2%, preferably from 0.001% to 0.05%.

The fibers 5, yarns 6 or fringe 7 are secured on a base layer 13 with the active ingredient distributed in and/or on the base layer 13 which inhibits or suppresses the growth of bacteria and/or viruses.

The active ingredient may be allocated to the base body 4 in zones in such a way that the zones in which the active ingredient is present form a pattern.

Embedding the active ingredient in the fibers 5, yarns 6 or fringe 7 allows for the dyeing of the fibers 5, yarns 6 or fringe 7 without losing the antibacterial or antimicrobial effects.

The base layer 13 as a component of the base body 4 may also be dyed without losing its antibacterial or antimicrobial effects.

The active ingredient may also be present only in the fringe 7. However, the active ingredient also may be present only in the base layer 13, which constitutes a component of the base body 4. However, the remote effect described previously would be established then only if the base layer 13 were relatively highly loaded with the active ingredient. Finally, it is possible that the active ingredient is present in the base layer 13 and in the fringe 7.

The active ingredient may also be present in a textile element applied separately to the base body 4, this textile element not fulfilling any function required for cleaning. In this way, the textile element is designed only as a carrier of the antimicrobial active ingredient but nevertheless is a component of the base body 4. With such an arrangement, it is essential that the active ingredient is accommodated within the component, namely being incorporated into it.

With regard to additional embodiments and refinements of the teaching according to the invention, reference is made first to the general part of the description and second to the accompanying patent claims.

The invention claimed is:

1. A flat wiping cloth for arrangement on a wiping cloth holder comprising:

an elongated base body; and an active ingredient that inhibits or suppresses the growth of bacteria or viruses allocated to the base body;

the base body having at least one of fibers, yarns or fringe, the fibers, yarns or fringe having free ends that can be turned to face a surface to be cleaned; and wherein the active ingredient is homogeneously distributed within a material of which the fibers, yarns or fringe is made or a material that makes up a component that is connected to the base body.

2. The flat wiping cloth according to claim 1, wherein the active ingredient is present in a nanoscale form.

3. The flat wiping cloth according to claim 1, wherein the active ingredient comprises elemental silver or another subgroup element.

4. The flat wiping cloth according to claim 3, wherein the active ingredient is present as a silver salt.

5. The flat wiping cloth according to claim 1, wherein the active ingredient is present in the fibers, yarns or fringe in an amount by weight of 0.0001% to 2%.

6. The flat wiping cloth according to claim 1, wherein the active ingredient is present in the fibers, yarns or fringe in an amount by weight of less than or equal to 0.001%.

7. The flat wiping cloth according to claim 1, further including at least one base layer connected to the elongated base body, wherein the fibers, yarns or fringe is secured to the at least one base layer, and wherein an active ingredient which inhibits or suppresses the growth of bacteria or viruses is distributed in or on the base layer.

8. The flat wiping cloth according to claim 1, wherein the active ingredient is allocated to the elongated base body in a plurality of zones defined in a plurality of regions of the elongated base body in such a way that the zones in which the active ingredient is present form a pattern.

9. The flat wiping cloth according to claim 1, wherein the fibers, yarns or fringe comprise microfibers.

10. The flat wiping cloth according to claim 1, wherein the base body includes at least one pocket into which a portion of a wiping cloth holder is insertable.

11. The flat wiping cloth according to claim 1, wherein the base body includes flat regions which can be applied to complementary receptacle regions of a wiping cloth holder in a form-fitting manner.

12. The flat wiping cloth according to claim 1, further including a wiping cloth holder.

13. A flat wiping cloth for arrangement on a wiping cloth holder comprising:

an elongated base body; and an active ingredient that inhibits or suppresses the growth of bacteria or viruses allocated to the base body;

the base body having at least one of fibers, yarns or fringe, the fibers, yarns or fringe having free ends that can be turned to face a surface to be cleaned;

wherein the active ingredient is distributed within a material of which the fibers, yarns or fringe is made or in a component of the base body; and wherein the active ingredient is accommodated in a ceramic carrier.

14. A flat wiping cloth for arrangement on a wiping cloth holder comprising:

an elongated base body; and an active ingredient that inhibits or suppresses the growth of bacteria or viruses allocated to the base body;

the base body having at least one of fibers, yarns or fringe, the fibers, yarns or fringe having free ends that can be turned to face a surface to be cleaned;

wherein the active ingredient is distributed within a material of which the fibers, yarns or fringe is made or in a component of the base body; and wherein the base body includes straps that are insertable into complementary receptacle devices of a wiping cloth holder in a form-fitting or force-locking manner.

* * * * *